US011884502B2

(12) United States Patent
Ellis

(10) Patent No.: US 11,884,502 B2
(45) Date of Patent: Jan. 30, 2024

(54) TAPE DISPENSER

(71) Applicant: Alphonso J. Ellis, Alpharetta, GA (US)

(72) Inventor: Alphonso J. Ellis, Alpharetta, GA (US)

( * ) Notice: Subject to any disclaimer, the term of this patent is extended or adjusted under 35 U.S.C. 154(b) by 0 days.

(21) Appl. No.: 17/647,383

(22) Filed: Jan. 7, 2022

(65) Prior Publication Data

US 2022/0127100 A1 Apr. 28, 2022

Related U.S. Application Data

(63) Continuation of application No. 16/948,248, filed on Sep. 10, 2020, now Pat. No. 11,247,865.

(51) Int. Cl.

| | |
|---|---|
| ***B65H 35/00*** | (2006.01) |
| ***B65H 37/00*** | (2006.01) |
| *E04F 21/165* | (2006.01) |

(52) U.S. Cl.

CPC ..... *B65H 35/0033* (2013.01); *B65H 35/0093* (2013.01); *B65H 37/007* (2013.01); *E04F 21/1657* (2013.01)

(58) Field of Classification Search

CPC ..... B65H 37/007; B65H 35/0093; B65H 35/0033

See application file for complete search history.

(56) References Cited

U.S. PATENT DOCUMENTS

| | | | | |
|---|---|---|---|---|
| 3,364,096 | A * | 1/1968 | Hetes | B65H 35/0033 156/577 |
| 5,269,871 | A * | 12/1993 | Longworth | B65H 35/0033 156/577 |
| 6,478,068 | B1 * | 11/2002 | Brown | B65H 35/0033 156/577 |
| 11,247,865 | B1 * | 2/2022 | Ellis | B65H 37/007 |

* cited by examiner

*Primary Examiner* — Alex B Efta

(74) *Attorney, Agent, or Firm* — Dunlap Bennett & Ludwig, PLLC

(57) ABSTRACT

A tape dispenser providing a dispensing assembly adapted to accommodate various widths of tape, wherein the dispensing assembly is operatively associated with a handle assembly to enable self-alignment of the dispensing tape and the dispensing assembly, and wherein a cutting assembly is operatively associated with the dispensing assembly for selectively cutting the dispensing tape.

9 Claims, 15 Drawing Sheets

20a
20
34

22
13
20a
20
13
18
30
34
40
38
40
38
40
38
40
38
40
32
36
35
34
20a
20
18

TAPE DISPENSER

CROSS-REFERENCE TO RELATED APPLICATION

This application claims the benefit of priority of U.S. nonprovisional application Ser. No. 16/948,248, filed 10 Sep. 2020, as a continuation thereof, the contents of which are herein incorporated by reference.

BACKGROUND OF THE INVENTION

The present invention relates to painting accessories and, more particularly, a paint dispenser providing a dispensing assembly adapted to accommodate various widths of tape. The dispensing assembly is operatively associated with a handle assembly to selectively self-align the dispensing assembly as a function of a particular width of tape being dispensed. A cutting assembly is operatively associated with the dispensing assembly for selectively cutting the tape when and where desired.

Dispensing paint tape can be more challenging than may be assumed by those who do not use them. First, even if one is painting just one wall, there still are yards of tape that must be dispensed very carefully so as to accurately define a line along which the paint may or may not be sprayed or brushed on. Also, at every discontinuity of tape, for example at a corner of a wall, the tape needs to be cut and reapplied. For do-it-yourselfers (DIY) as well as professionals, the above-mentioned time-consuming tasks demand such an attention to detail that mistakes are not uncommon. Each mistake requires re-taping, of course.

Furthermore, current tape dispensers do not work with various widths of masking tape because they do not have an integrated aligning mechanism. They also do not have a built-in cutter. As a result, other devices do not enable users to align, dispense, and cut tape efficiently and accurately, especially various widths of masking tape.

As can be seen, there is a need for a paint tape dispenser adapted to accommodate various tape widths, while providing a built-in cutter and self-aligning functionality for the dispensing tape, thereby making it simpler, more efficient and more accurate for DIYs and professionals painters to align, dispense, and cut painters tape.

SUMMARY OF THE INVENTION

In one aspect of the present invention, a tape dispenser includes the following: a body plate providing three attachment points in a triangular arrangement; and a first attachment point of the three attachment points operatively associated with a tape hub in such a way that the tape hub is rotatably and telescopically connected thereto.

In another aspect of the present invention, the tape dispenser includes the following: body plate having a front surface and a rear surface opposing the front surface, the front surface providing three attachment points in a triangular arrangement; a first attachment point of the three attachment points operatively associated with a tape hub in such a way that the tape hub is rotatably and telescopically connected thereto; a second attachment point and third attachment point of the three attachment points rotatably connected to two roller assemblies, respectively; a handle pivotable connected to the rear surface; a handle lock configured to move the handle between a locked condition and an unlocked pivotable condition; one or more locking mechanism disposed along the tape hub, each locking mechanism movable between an unlocked position and a locked position fixing an outward face of the tape hub relative to said first attachment point; a cutting handle pivotably connected about said first attachment point; the cutting handle providing a nesting beak on each distal end, each nested beak having a mouth; a cutting blade disposed upward and inward of a center of each of the roller assemblies; and the cutting blade disposed along a nested cavity, wherein the nesting beak is dimensioned to be slidably received in the nested cavity so that the cutting blade is slidably received in said mouth.

These and other features, aspects and advantages of the present invention will become better understood with reference to the following drawings, description and claims.

DETAILED DESCRIPTION OF THE INVENTION

Figure 1:
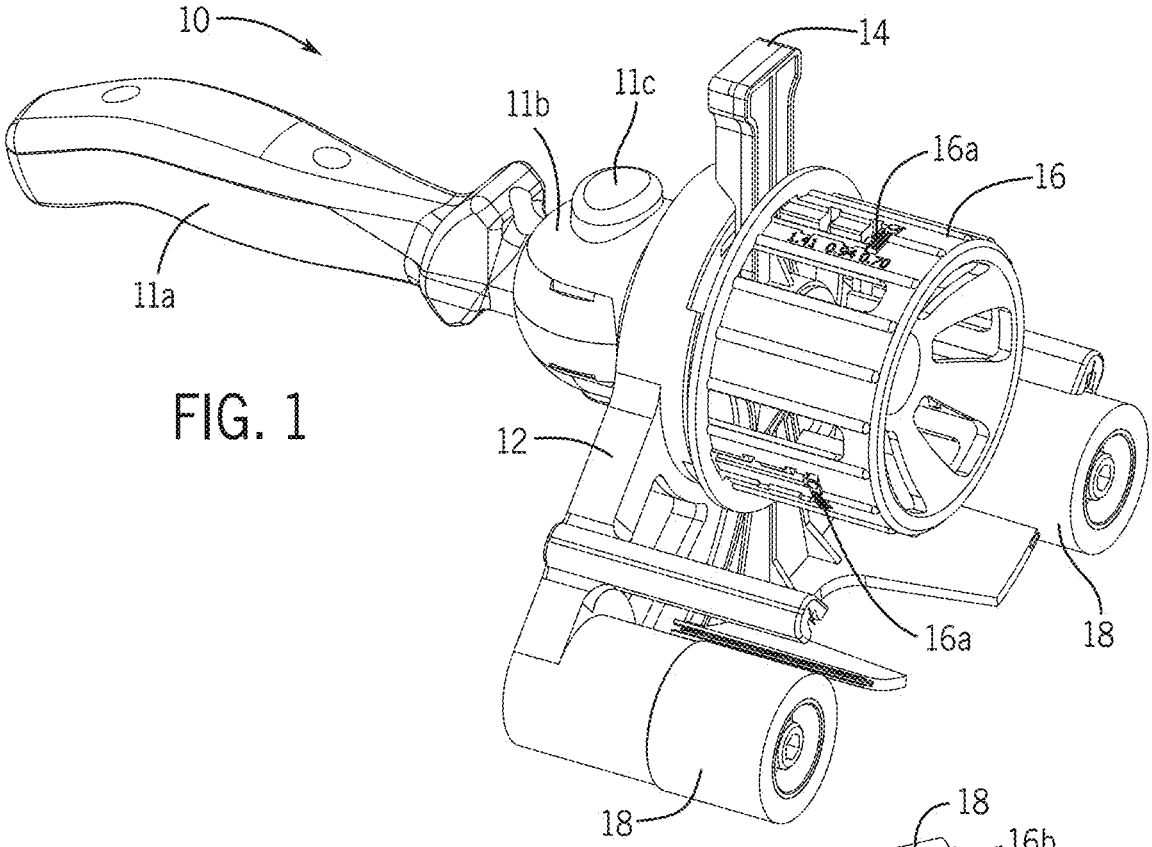
FIG. 1 is a perspective view of an exemplary embodiment of the present invention.
Figure 2:
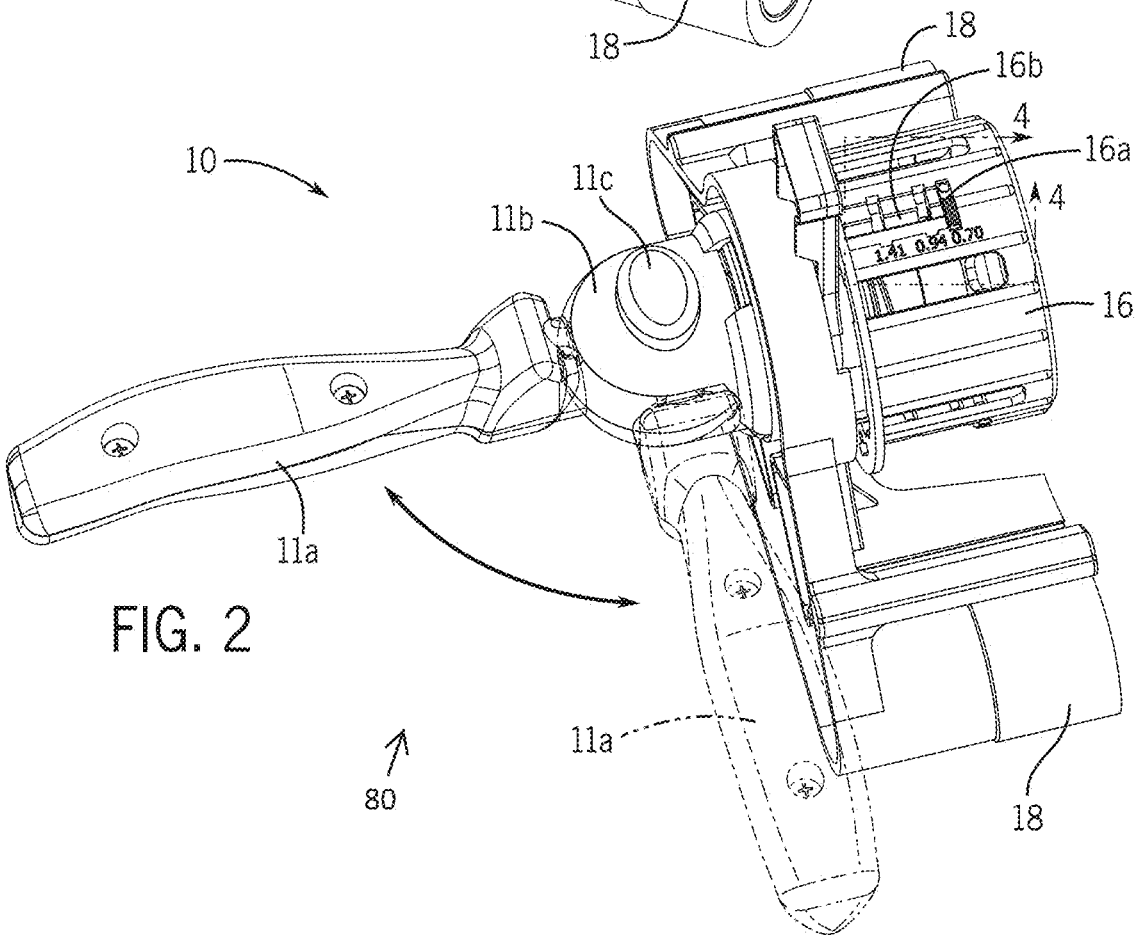
FIG. 2 is a top perspective view of an exemplary embodiment of the present invention, illustrating pivoting the handle 11*a* of the alignment handle assembly 80.
Figure 3:
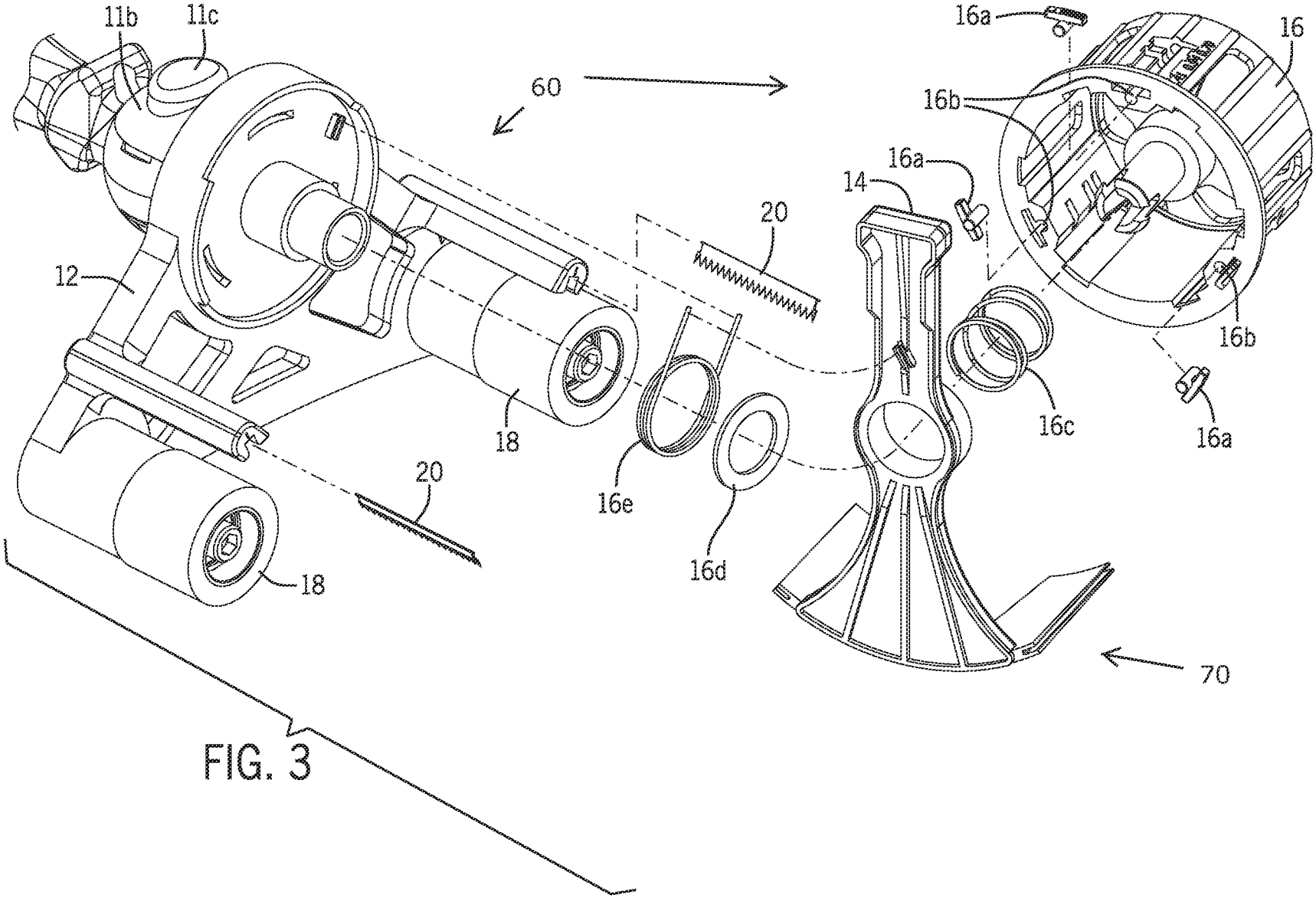
FIG. 3 is a clamshell-type exploded perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a tape dispenser providing a dispensing assembly adapted to accommodate various widths of tape, wherein the dispensing assembly is operatively associated with a handle assembly to enable self-alignment of the dispensing tape and the dispensing assembly, and wherein a cutting assembly is operatively associated with the dispensing assembly for selectively cutting the dispensing tape.

Referring now to FIGS. 1 through 13, the present invention provides a tape dispenser 10, 30 having a dispensing assembly 60 operatively associated with a cutting assembly 70 and an alignment handle assembly 80.

The dispensing assembly 60 may include a body plate 12, 32 having a front surface and an opposing rear surface. The front surface may interconnect a tape hub 16 and two roller assemblies 18, generally, in a triangular arrangement so that a tape roll 22, engaged by the tape hub 16, enables a tape strip 22*a* from the tape roll 22 to extend and operatively associate with the two roller assemblies 18. In certain embodiments, the body plate 12, 32 provides three attachment points: a first attachment point adapted to facilitate a rotatably association relative the tape roll 22 by way of the tape hub 16, while separately the second attachment point and the third attachment point are rotatable associated with the two roller assemblies 18, respectively.

The rear surface of the body plate 12, 32 may be pivotably connected to a handle 11*a*. The handle 11*a* may provide a handle hub 11*a* about which the handle 11*a* pivots, wherein the handle hub 11*b* provides a handle lock 11*c* operative to move the handle 11*a* between a locked condition and an unlocked condition. The handle 11*a*, the handle hub 11*b*, and the handle lock 11*c* at least in part forms the alignment handle assembly 80, which enables users to self-align various widths of tape strips 22*a* operatively associated with the tape hub 16, as explained further below.

The tape hub 16 provide a circumferential shell that can host a variety of tape-roll widths, from a quarter of an inch or less to three inches or more. The tape hub 16 may be telescopically associated with the first attachment point by way of an interconnecting spring 16*c* or the like. As a result, the tape hub 16 is movable toward the body plate 12, 32 through sufficient urging in that inward direction to overcome an outward bias imposed by the spring 16*c*. Thereby, tape rolls 22 of different widths can be accounted for as the telescopic association enables different alignments of the tape hub 16 relative to the roller assemblies 18. The tape hub 16 may provide locking channels 16*b*, each locking channel 16*b* having a locking mechanism 16*a* that can be operatively associated and disassociated with the tape hub 16, placing the tape hub 16 between a locked position and an unlocked position, respectively.

The first attachment point also enables a pivot point about which a cutter handle 14 or an actuation handle 35 pivots (the cutter handle 14 and the actuation handle 35 are alternative embodiments of the cutting assemble 70). The pivot point may associate with pivot-regulating fasteners 16*d* and 16*e* to limit an amplitude or angle that the cutter handle 14 or the actuation handle 35 can pivot relative to the pivot point and/or bias the cutter handle 14/actuation handle 35 in a disabled condition, for example in a north-south orientation. In certain embodiments, the pivot-regulating fasteners 16*d* may include a torsion spring having a first leg connected to the body plate 12 or 32 and the second leg connected to the cutter handle 14 or the actuation handle 35 to provide counterbalance.

Figure 8:
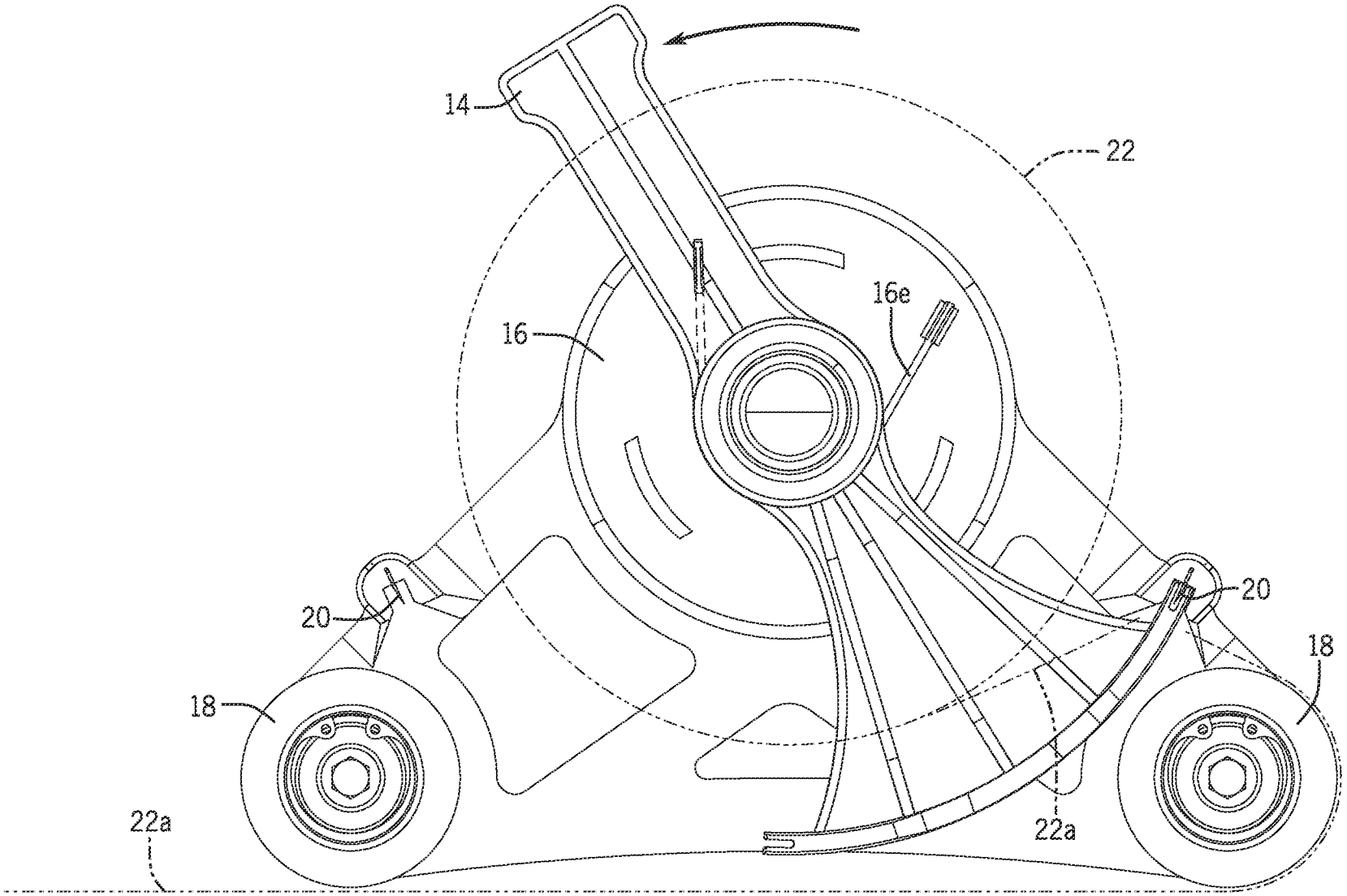
FIG. 8 is a side elevation view of an exemplary embodiment of the present invention shown in use, illustrating pivoting of the cutting handle 14.
Figure 9:
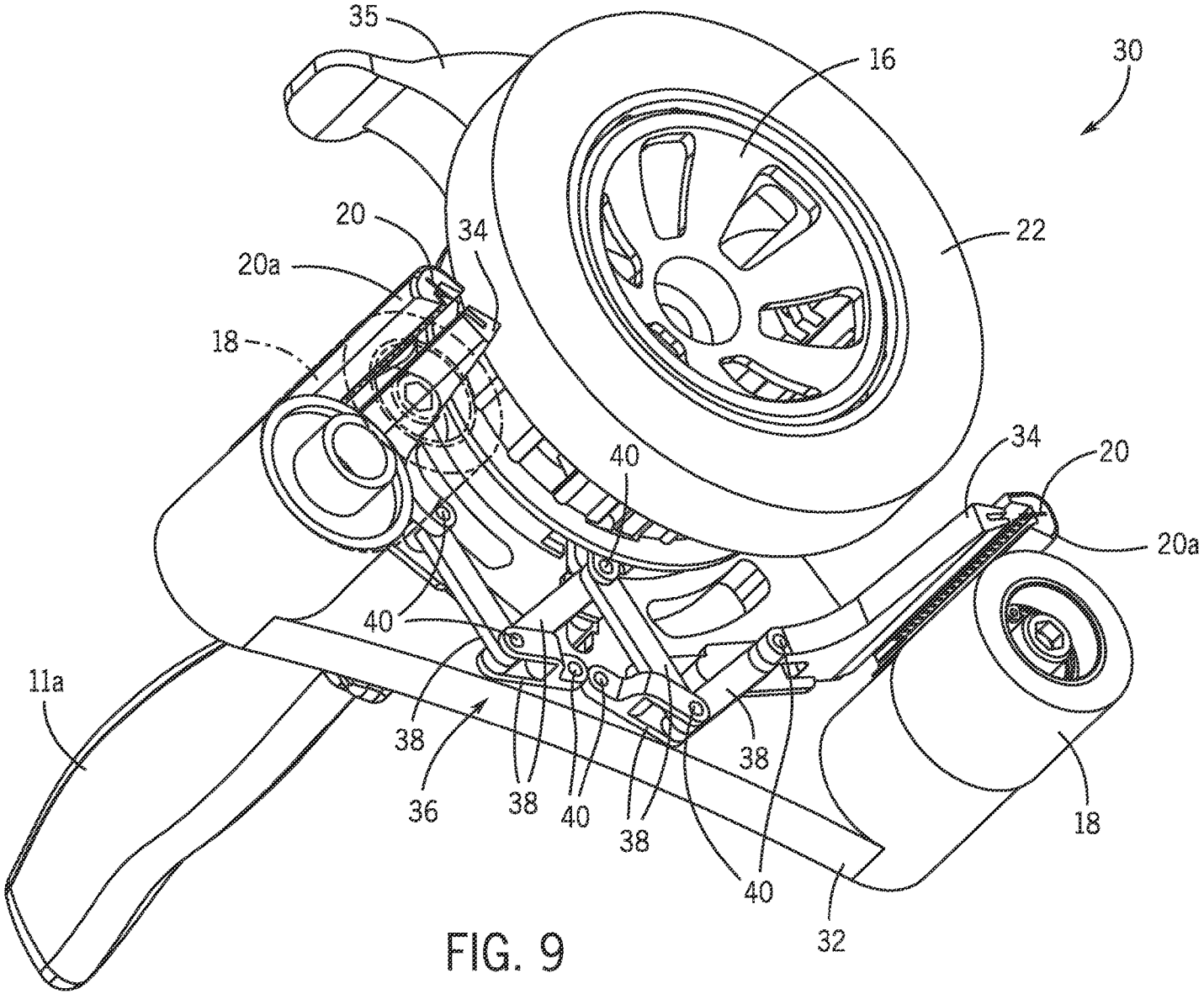
FIG. 9 is a bottom perspective view of an exemplary embodiment of the present invention.
Figure 10:
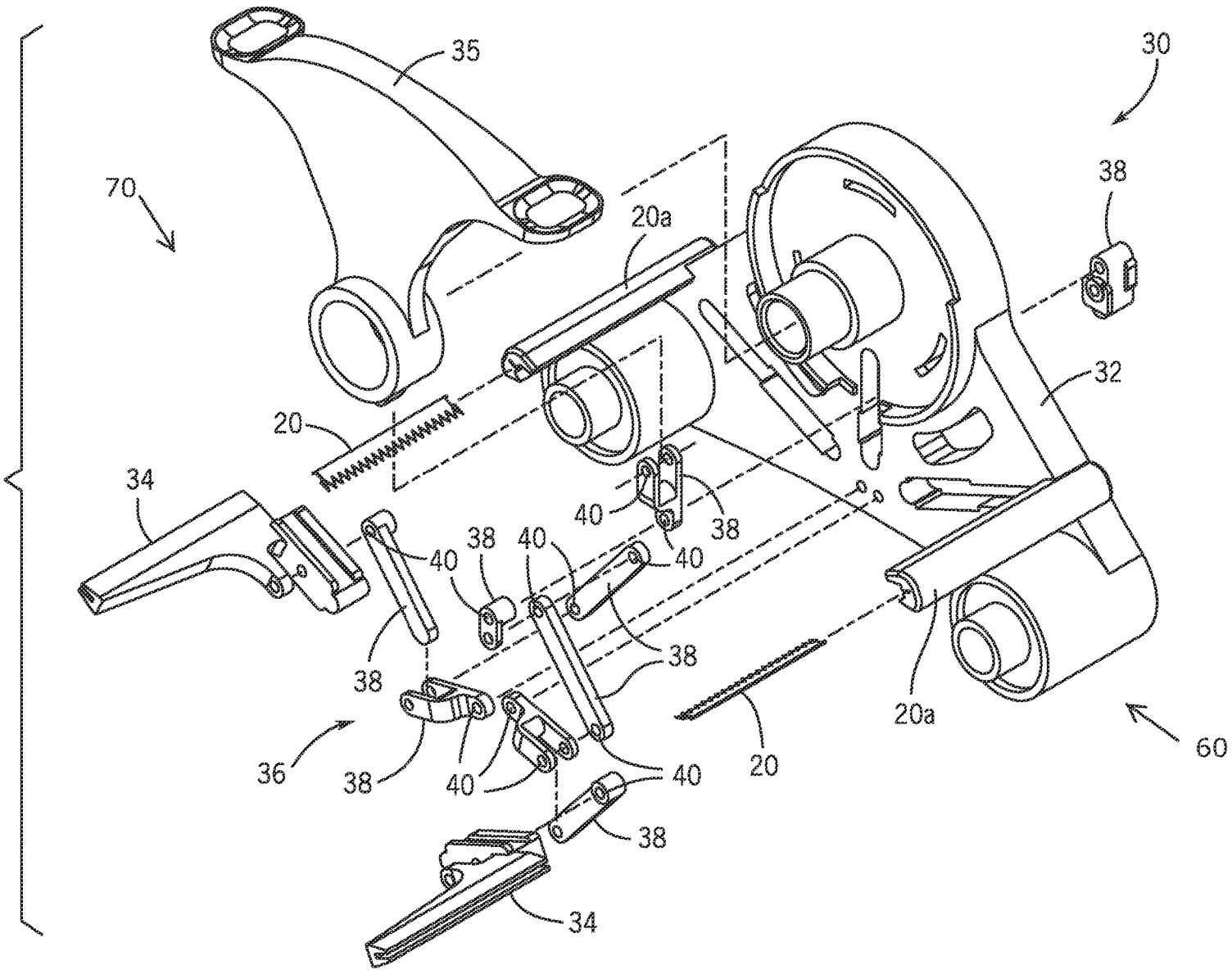
FIG. 10 is an exploded perspective view of an exemplary embodiment of the present invention.
Figure 11:
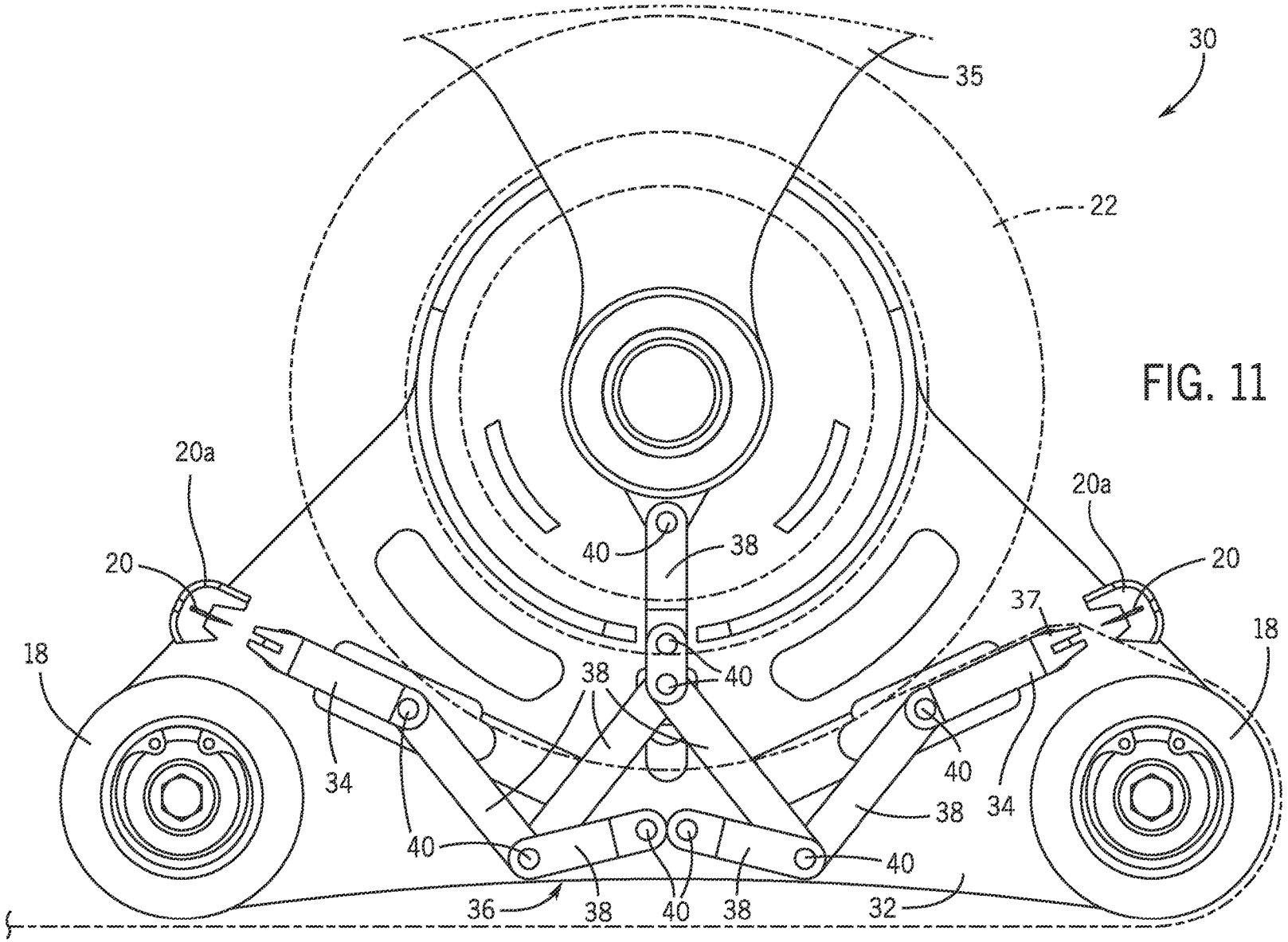
FIG. 11 is a side elevation view of an exemplary embodiment of the present invention, showing linkage in a retracted orientation (the actuation handle 35 being idle)

The cutting assembly 70 may provide at least one cutting arm 20*a* having a cutting implement 20. Each cutting arm 20*a* may be connected to the body plate 12 or 32 so that a cutting blade of the cutting implement 20 is disposed upward and inward of a respective roller assembly 18 (at least its axis of rotation), as illustrated in FIGS. 8 and 9. Each cutting implement 20 may be nested in a recessed nesting cavity along the respective cutting arm 20*a*.

Figures 12, 13:
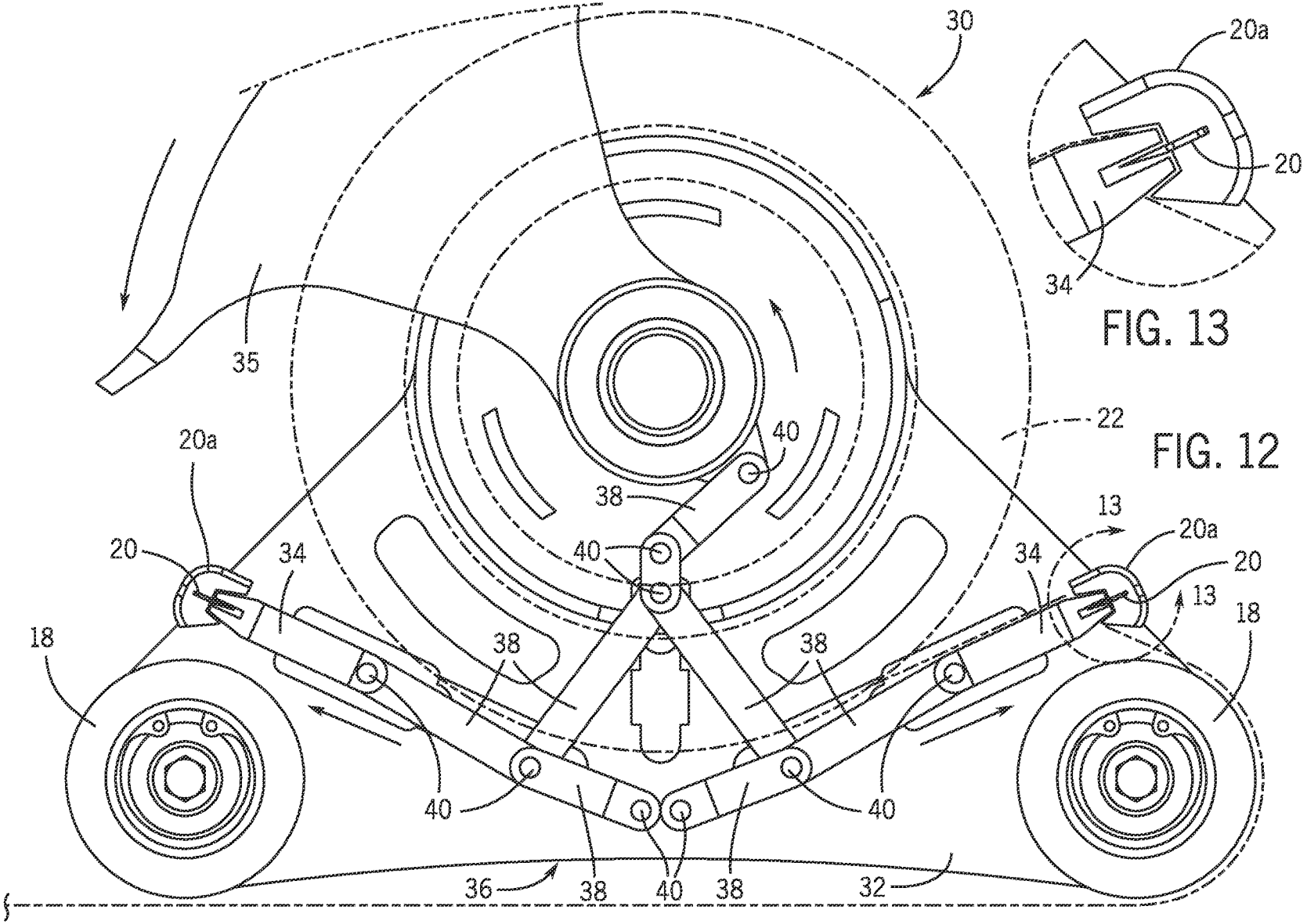
FIG. 12 is a side elevation view of an exemplary embodiment of the present invention, showing linkage in an actuated/cutting orientation as a result of pivoting the actuation handle 35.
FIG. 13 is a detail side elevation view of an exemplary embodiment of the present invention, indicated by the line 13-13 of FIG. 12.
Figure 14:
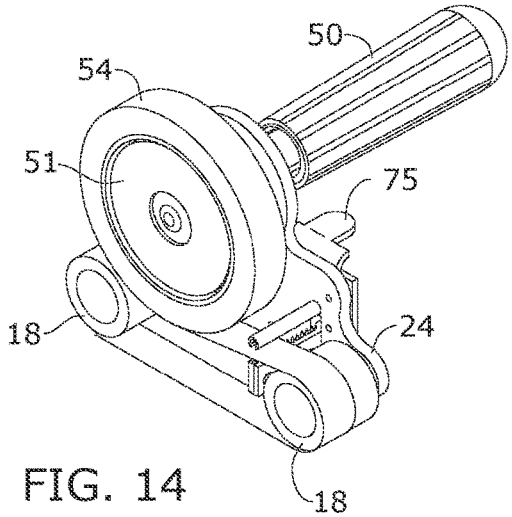
FIG. 14 is a perspective view of an exemplary embodiment of the present invention, shown in use with a tape spool 54.
Figure 15:
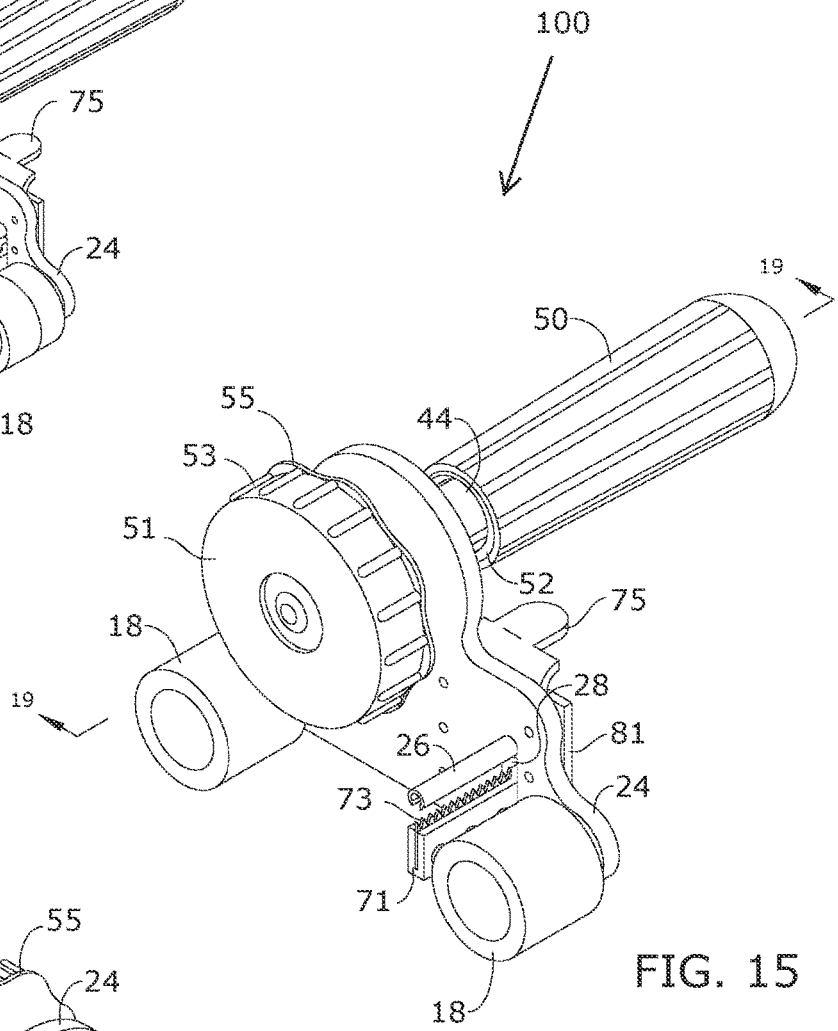
FIG. 15 is a front perspective view of an exemplary embodiment of the present invention.
Figure 16:
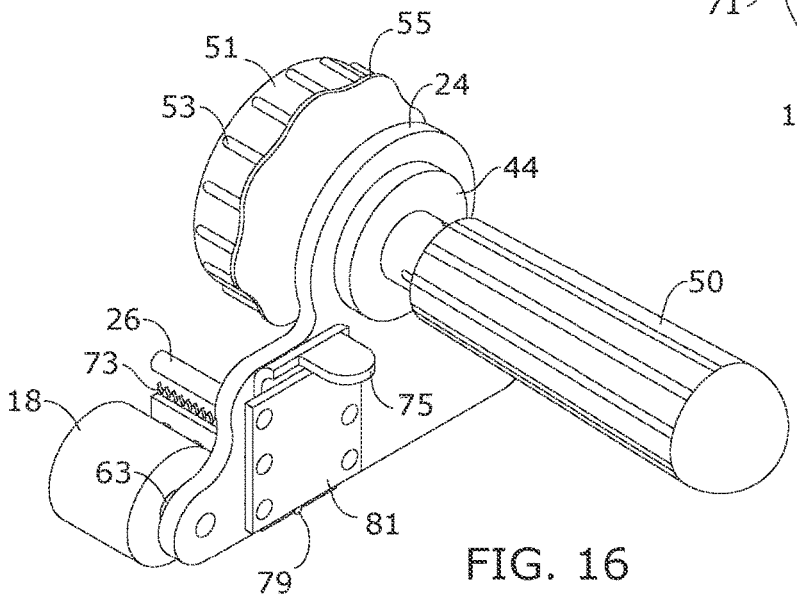
FIG. 16 is a rear perspective view of an exemplary embodiment of the present invention.

The cutting assembly 70 further includes one or more nesting beak 37 dimensioned and adapted to slidable be received in the nesting cavity so that the 'mouth' of the nesting beak 37 sufficiently receives the cutting blade so as to cut a tape strip 22*a* disposed in said mouth receiving the cutting blade, as illustrated in FIG. 13. The nesting beaks 37 may be disposed on opposing sides of a distal end of the cutter handle 14 or, in the actuation handle 35 embodiment, a distal end of a pusher arm 34. The pusher arm 34 may be operatively associated with the actuation handle 35 by linkage components 38 and linkage pivots 40. When there are two pusher arms 34, in the actuation handle 35 embodiment, the linkage components 38 and linkage pivots 40 may be adapted in a mirrored configuration 36, as illustrated in FIG. 9. In either embodiment, urging the cutter handle 14 or the actuation handle 35 to pivot about the first attachment point urges a nesting beak 37 to slide toward and/or into the nesting cavity, cutting any tape strip 22*a* therein.

A method of using the present invention may include the following. The tape dispenser 10 or 30 disclosed above may be provided. A user would place a tape roll 22 of the desired width onto the tape hub 16. Then the user loosens the pivotable handle 11*a* and presses the dispensing assembly 60 against a surface until the outer face of the tape roll 22 and the roller assemblies 18 align—this enables the use of various widths of tape, since the dispensing assembly 60 is adjustable. Then the user tightens or locks the pivotable handle 11*a*, locking the dispensing assembly 60 (and tape roll 16 and rollers 18) in their aligned position. Then the user may extend the tape strip 22*a* from the tape roll 22 until it operatively associates with the two roller assemblies 18, with the adhesive surface, of course, downward facing toward the taping surface 22*b*—i.e., feeding the tape strip 22*a* through the cutter assembly 80 and around the rollers 18. The user places the unit on to the taping surface 22*b* to be masked, and with the rollers 18 aligned to the adjoining surface (e.g., the wall against which the taping surface 22*b* abut) rolls the tape strip 22*a* to the desired length. Then the user selectively pivots the cutter handle 14 or actuation handle 35 to cut the tape strip 22*a*.

An Additional Embodiment

Broadly, an embodiment of the present invention provides a paint tape dispenser providing a dispensing assembly adapted to accommodate various widths of tape, wherein the dispensing assembly is operatively associated with a handle assembly to self-align the dispensing tape, and wherein a cutting assembly is operatively associated with the dispensing assembly for cutting the tape when desired.

Referring now to FIGS. 14 through 26, the present invention provides a tape paint dispenser 100 having a dispensing assembly 60 operatively associated with a cutting assembly 70 and an alignment handle assembly 80.

Figure 17:
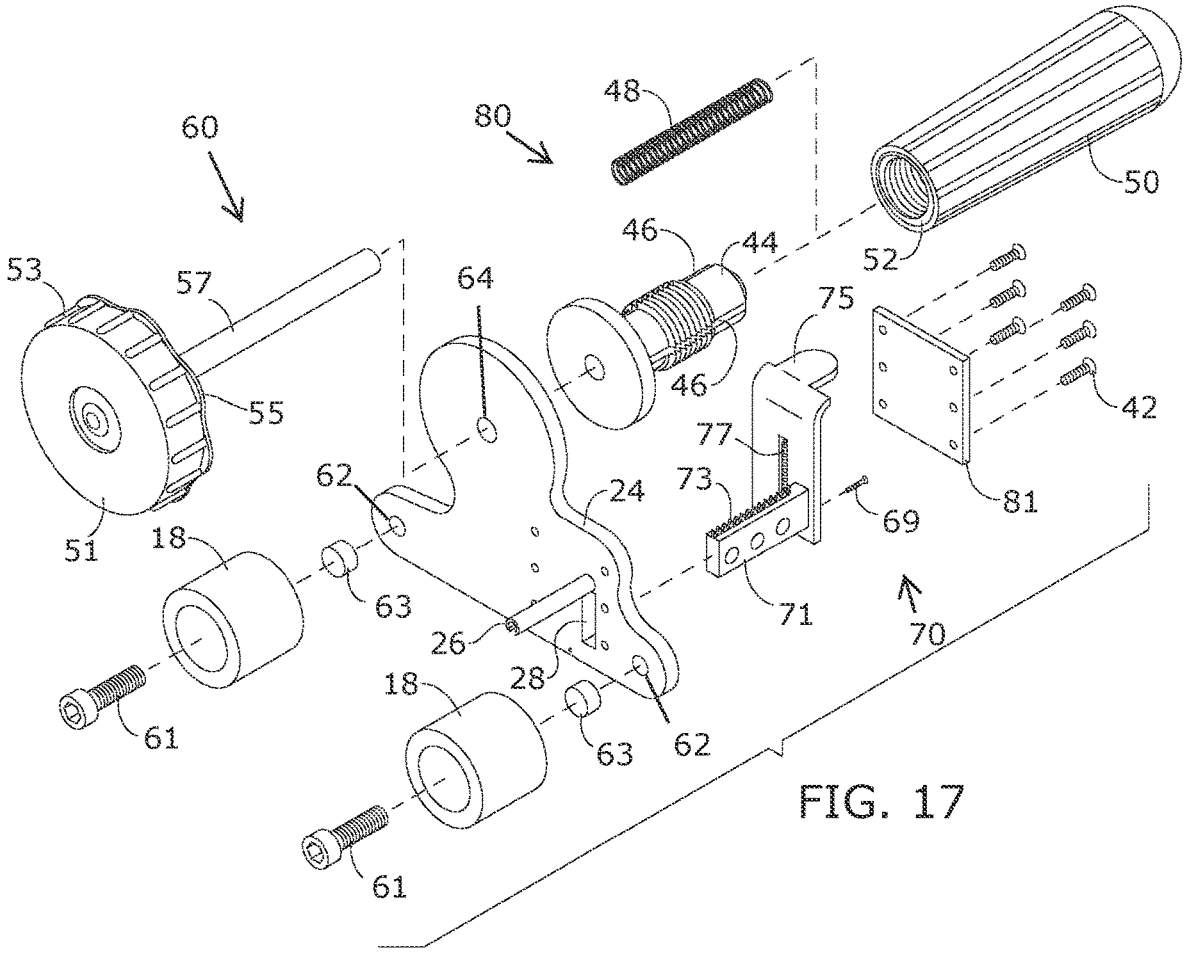
FIG. 17 is a front exploded view of an exemplary embodiment of the present invention.
Figure 18:
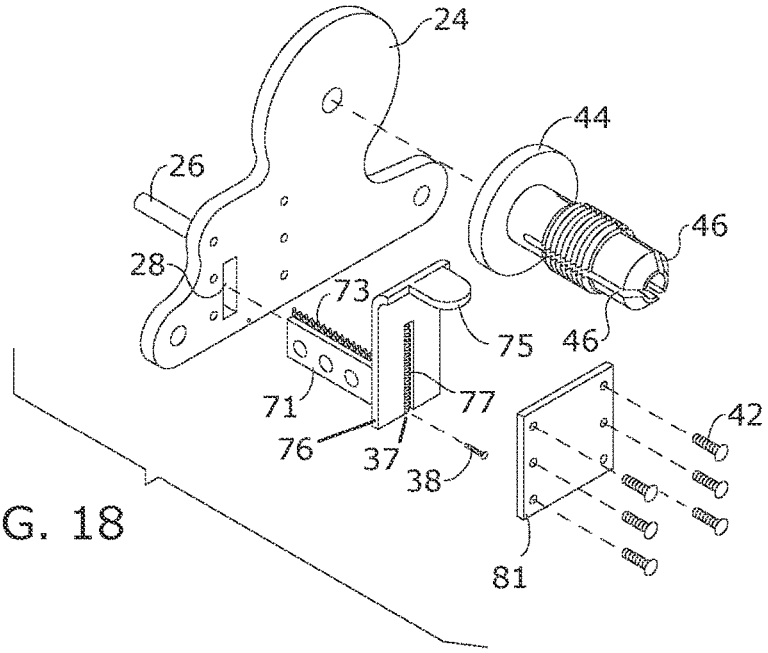
FIG. 18 is a rear detail exploded view of an exemplary embodiment of the present invention.
Figure 19:
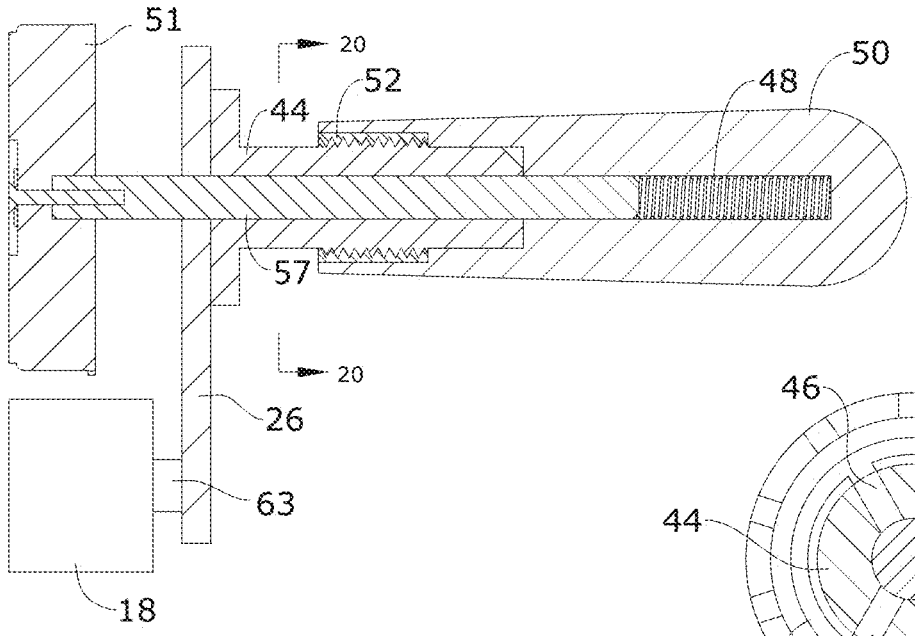
FIG. 19 is a section view of an exemplary embodiment of the present invention, taken along line 19-19 in FIG. 15.
Figure 20:
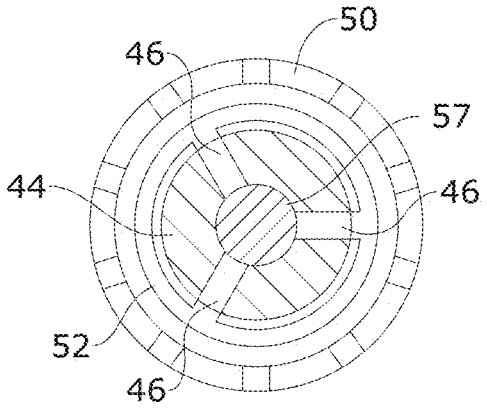
FIG. 20 is a section view of an exemplary embodiment of the present invention, taken along line 20-20 in FIG. 19.
Figure 21:
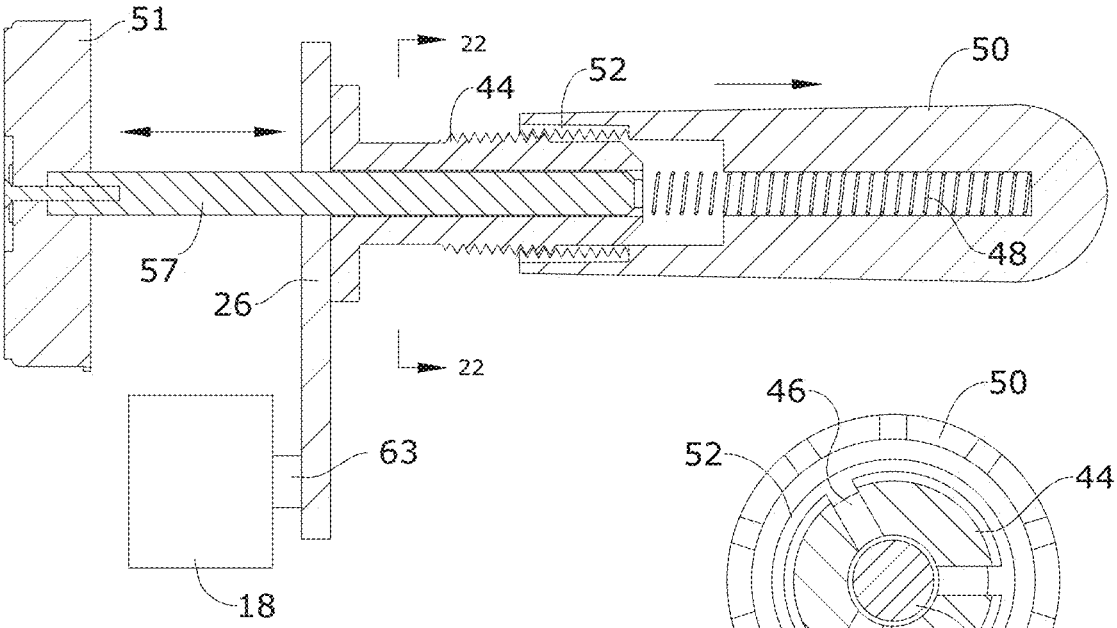
FIG. 21 is a section view of an exemplary embodiment of the present invention, showing the loosening of handle 50 to release rod 16.
Figure 22:
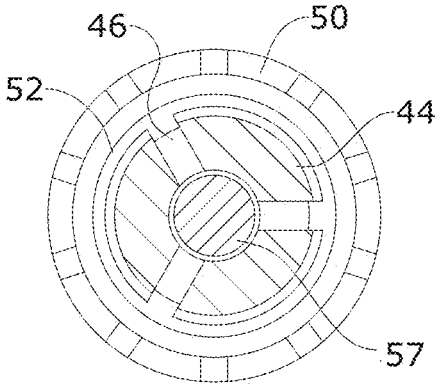
FIG. 22 is a section view of an exemplary embodiment of the present invention, taken along line 22-22 in FIG. 21, illustrating the loosened position of the flange-mount threaded collar 44.
Figure 23:
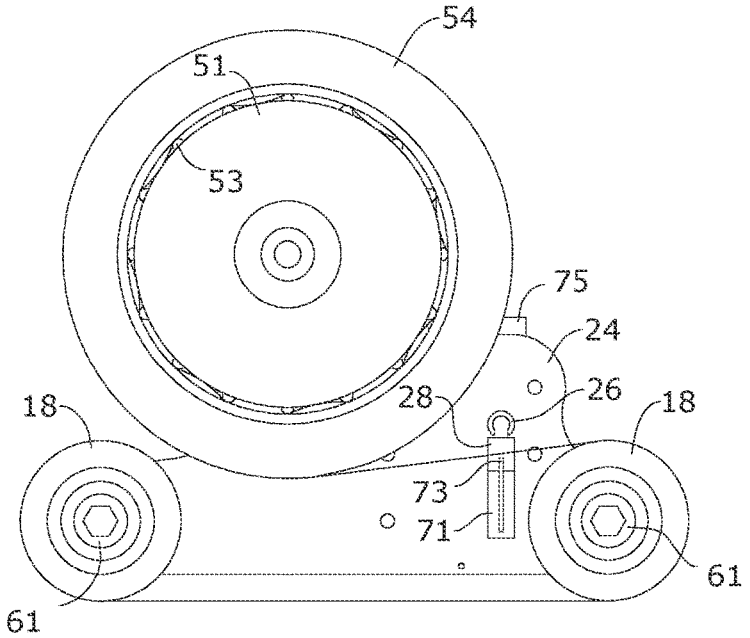
FIG. 23 is a front view of an exemplary embodiment of the present invention, shown with tape spool 54 in place.
Figure 24:
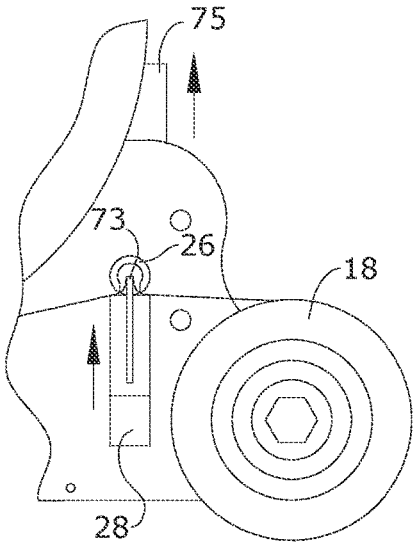
FIG. 24 is a detail front view of an exemplary embodiment of the present invention, illustrating use of the cutter.
Figure 25:
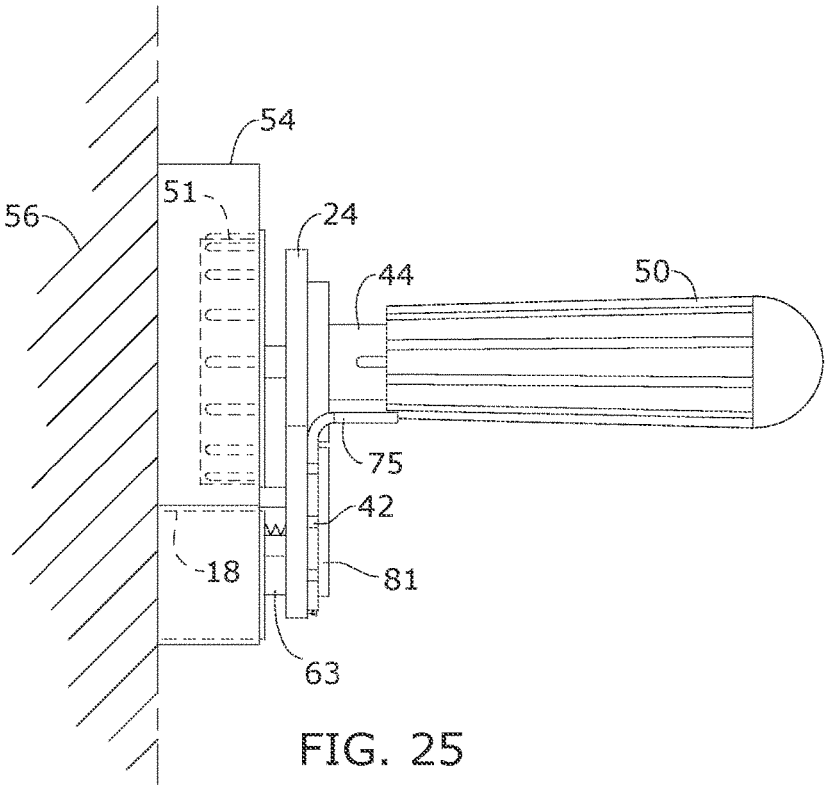
FIG. 25 is a side view of an exemplary embodiment of the present invention, illustrating the alignment to a wall.
Figure 26:
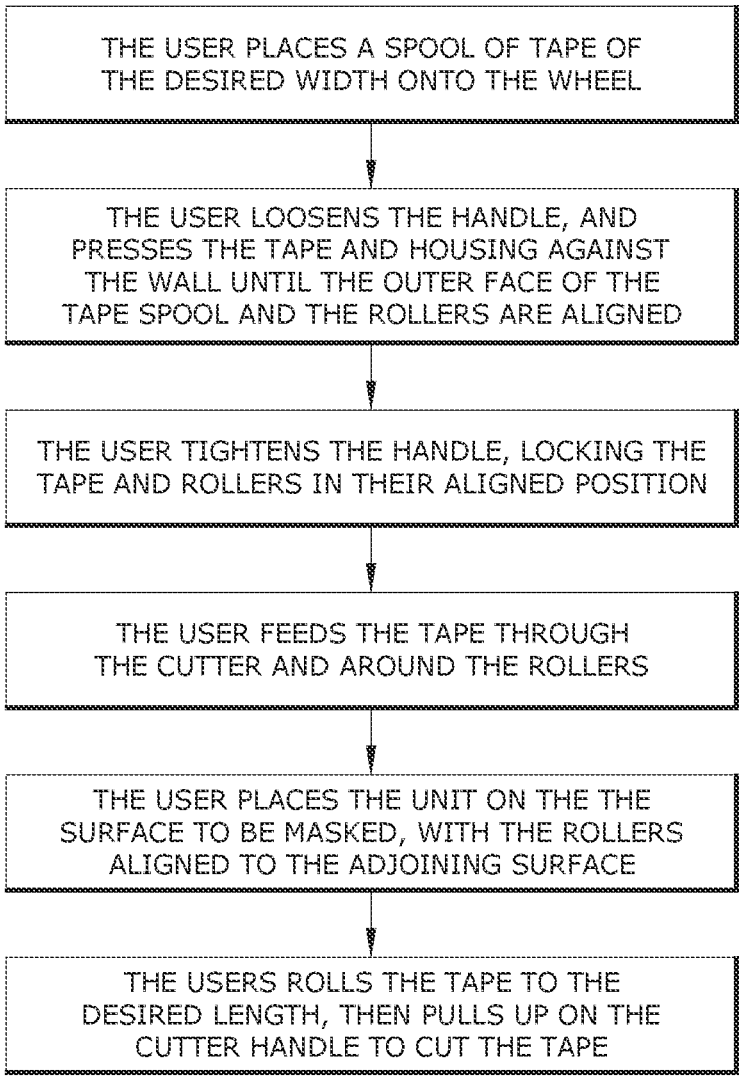
FIG. 26 is a flow chart of an exemplary embodiment of the present invention.

The dispensing assembly 60 may include a body plate 24 providing three through-holes oriented in a triangular arrangement: an apex hole 64 disposed between and above two base holes 62, as illustrated in FIG. 17. The dispensing assembly 60 may extend from a first surface of the body plate 24. A roller assembly 18, such as a roller with bearings, may extend from the two spaced apart base holes 62. Each such roller assembly 18 may be fastened to its respective base hole 62 by a connector 61 and a spacer 63. A tape wheel 51, via a wheel rod 57, may extend from the apex hole 64. the circumferential periphery of the tape wheel 51 may provide spaced apart spool grips 53. A spool stop 55 may be sandwiched between the tape wheel 51 and the body plate 24.

Figure 4:
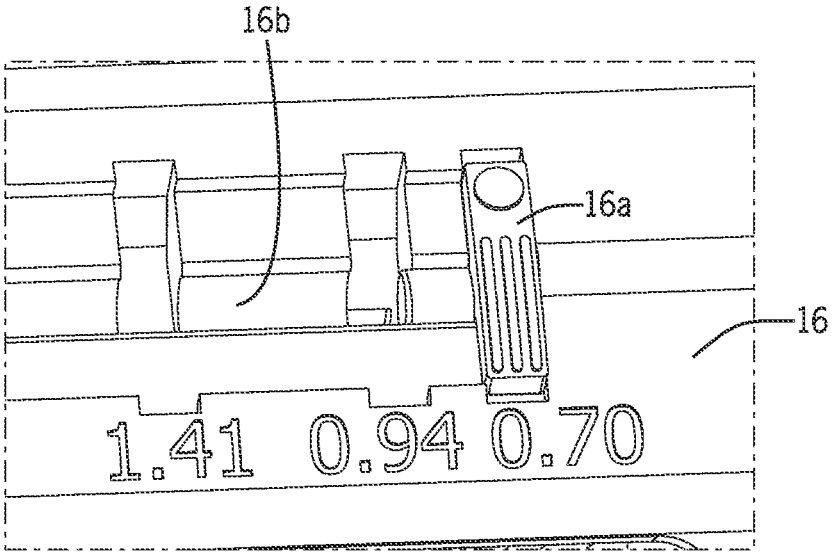
FIG. 4 is a detail perspective view of an exemplary embodiment of a tape lock of the present invention.
Figure 4A:
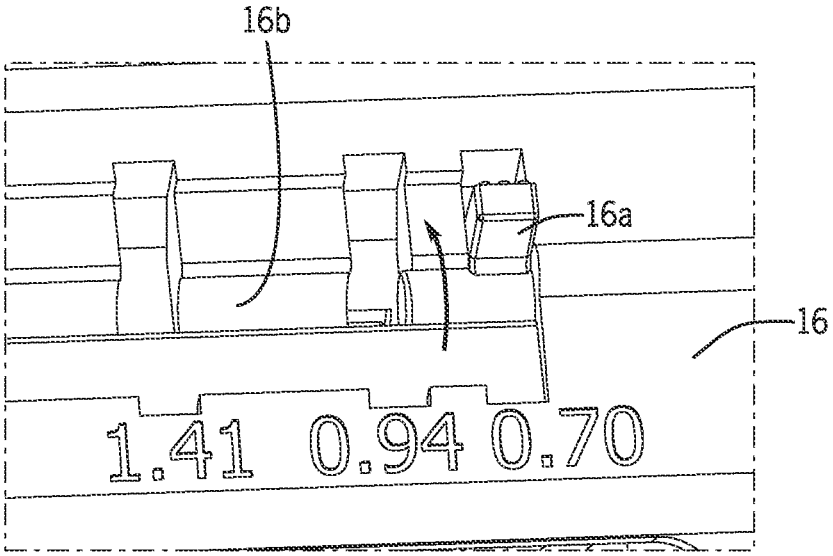
FIG. 4A is a detail perspective view of an exemplary embodiment of the present invention, showing the tape lock in a locked position.
Figure 4B:
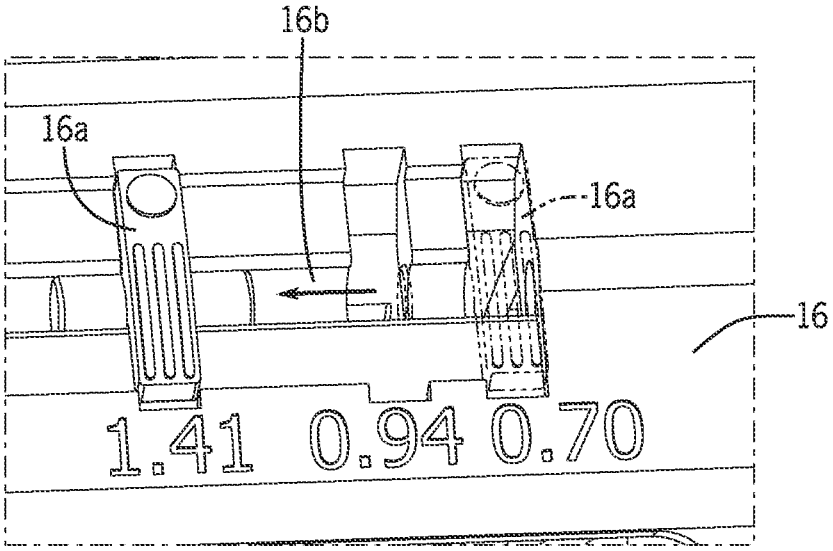
FIG. 4B is a detail perspective view of an exemplary embodiment of the present invention, showing the tape lock in an alternative position.
Figure 6:
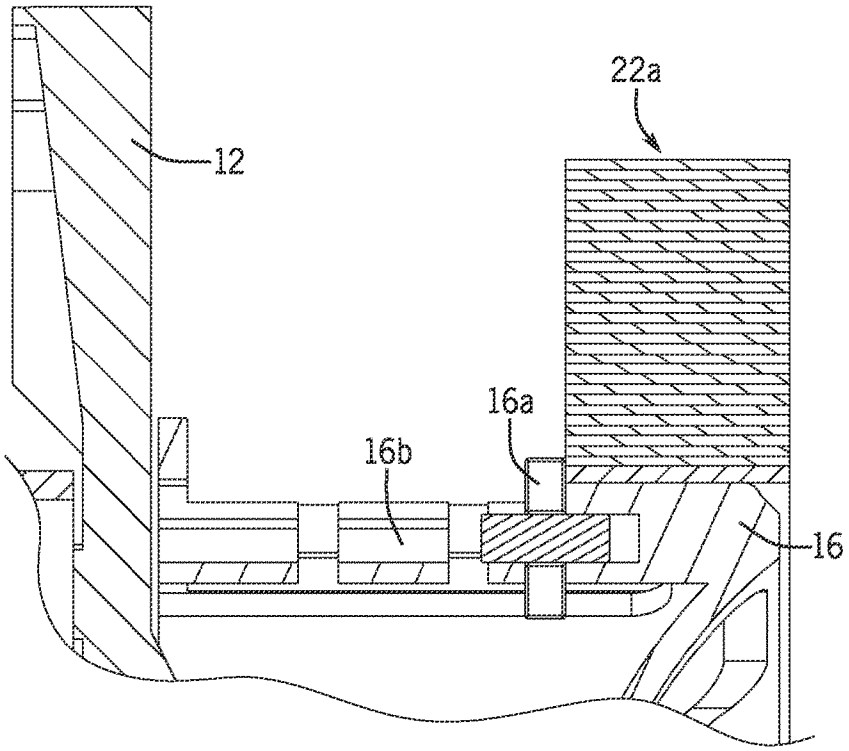
FIG. 6 is a partial cross-sectional view of an exemplary embodiment of the present invention, indicated by line 6-6 in FIG. 5.
Figure 5:
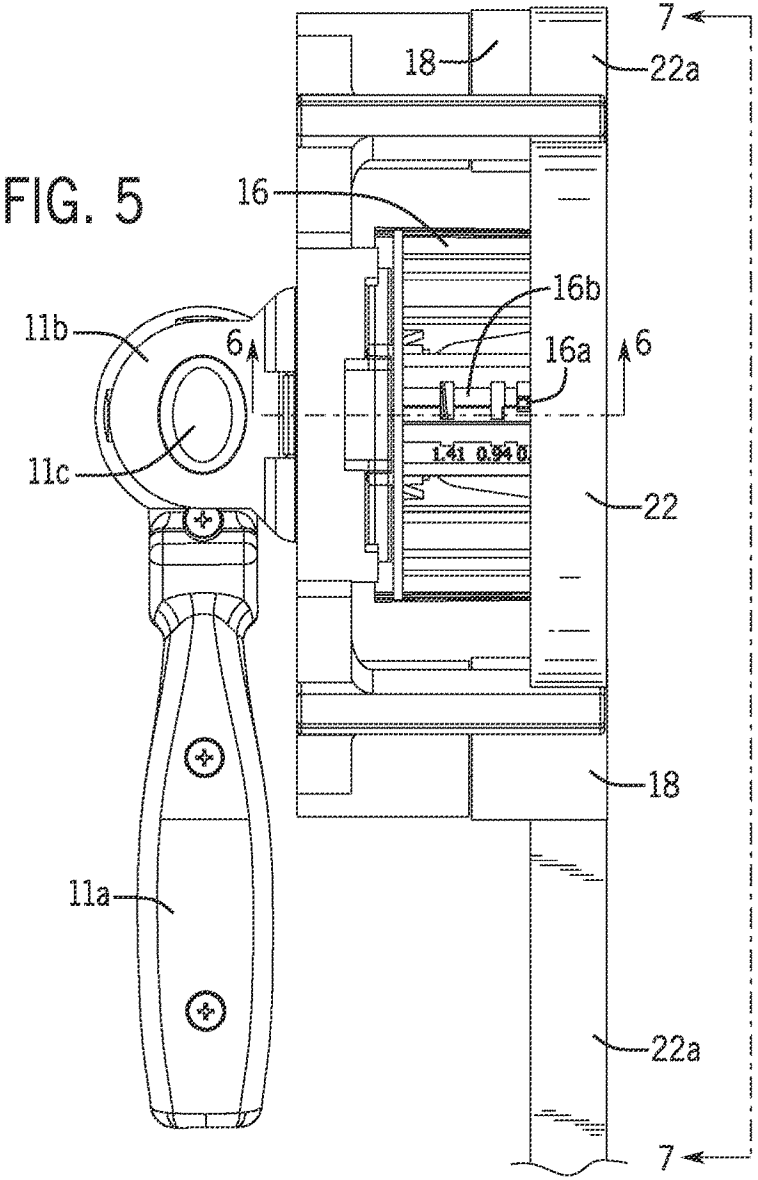
FIG. 5 is a top plan view of an exemplary embodiment of the present invention.
Figure 7:
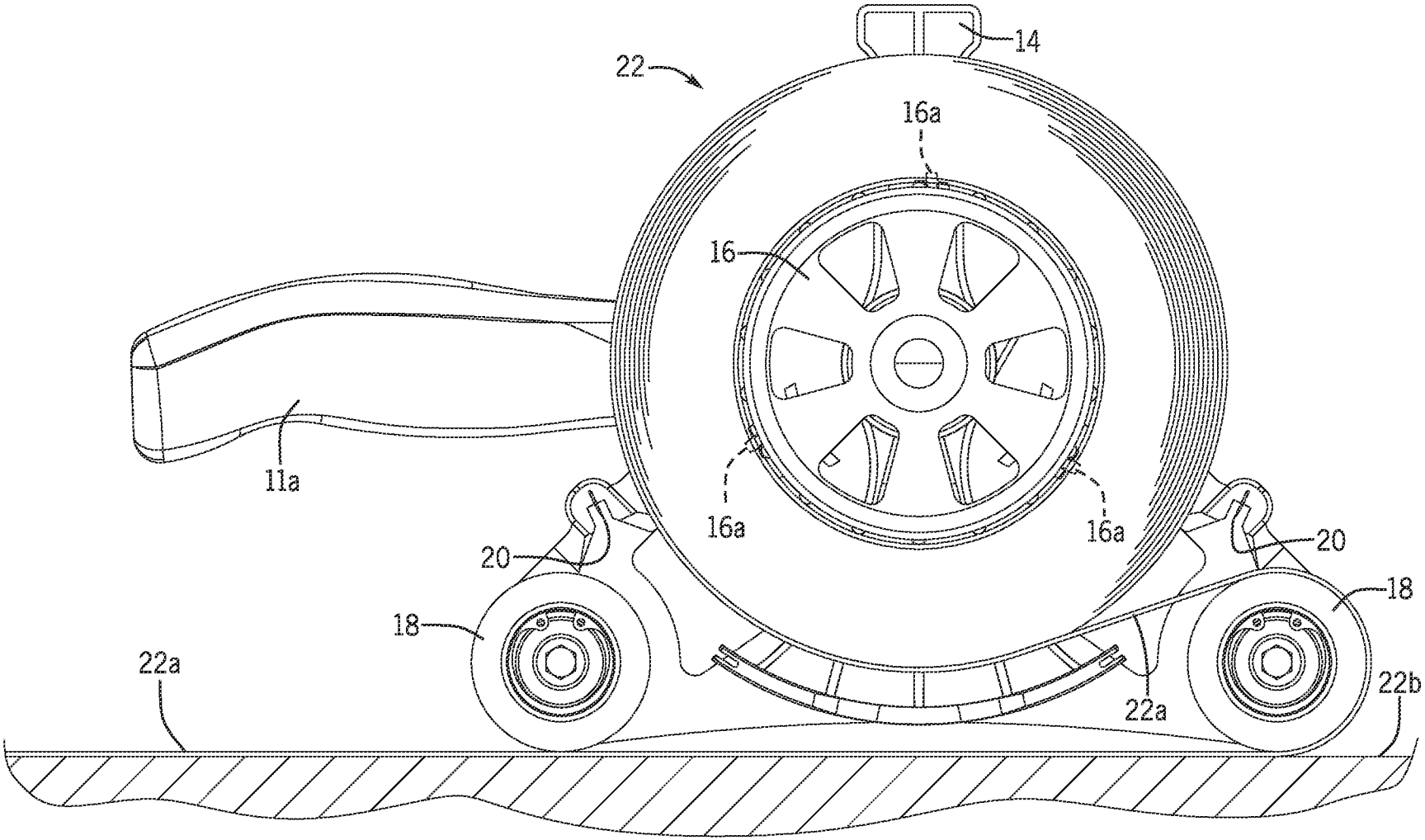
FIG. 7 is a side elevation view of an exemplary embodiment of the present invention, indicated by line 6-6 in FIG. 5, shown in use.

The cutting assembly 70 may provide a cutter body 76 providing a generally transverse cutter handle 75. The cutter body 76 may provide a spring slot 37 housing a spring 77 therein, wherein the spring slot 37 may be disposed on an opposing end of the cutter body 76 relative to the cutter handle 77, as illustrated in FIGS. 4 and 5. Operatively associated with the spring 77 may be cutter base 71 providing a cutter blade 73. The cutter body 76 may be disposed against a second surface of the body plate 24, opposite the first surface, so that the cutter base 71 extends through a body plate slot 28 of the body plate 24, whereby the cutter base 71 extends from the first surface. Also extending from the first surface and aligned with and spaced apart from the cutter blade 73 may be a receiving rod 26. The cutter body 76 may be connected to the body plate 24 by fasteners 79 as well as a back plate 81 with additional connectors 42.

The handle assembly 80 may be mounted to the wheel rod 57 portion that extends from the second surface. The handle assembly 80 may provide a flanged threaded collar 44 that receives said wheel rod 16 portion therein. Along a periphery of the threaded collar 44 may be circumferential threading and longitudinal slots 46. The periphery is dimensioned and adapted to sliding in a threaded opening 52 of the main handle 50, while a resilient spring 48 engages the longitudinal slots 46.

A method of using the present invention may include the following. The tape paint dispenser 100 disclosed above may be provided. A user would place a spool of tape 54 of the desired width onto the tape wheel 51. Then the user loosens the main handle 50 and presses the dispensing assembly 60 against a taping surface 56 until the outer face of the tape spool 54 and the roller assemblies 18 align—this enables the use of various widths of tape, since the dispensing assembly 60 is adjustable. Then the user tightens the main handle 50, locking the dispensing assembly 60 (and tape spool 54 and roller assembliesl 8) in their aligned position. The user feeds the tape through the cutter assembly 80 and around the roller assemblies 18, as illustrated in FIGS. 14 and 23-25. The user places the unit on to the taping surface 56 to be masked, and with the roller assemblies 18 aligned to the adjoining surface rolls the tape to the desired length. Then the user pulls up on the cutter handle 43 to cut the tape.

It should be understood, of course, that the foregoing relates to exemplary embodiments of the invention and that modifications may be made without departing from the spirit and scope of the invention as set forth in the following claims.

What is claimed is:

1. A tape dispenser comprising:

a body plate providing three attachment points in a triangular arrangement; and a first attachment point of the three attachment points operatively associated with a tape hub in such a way that the tape hub is rotatably and telescopically connected thereto so that urging the tape hub toward the body plate moves an outward face of the tape hub from a biased outward position to a locked inward position, whereby the outward face is selectively movable relative to the body plate.

2. The tape dispenser of claim 1, wherein the tape hub is dimensioned to engage an inner circumference of a tape roll.

3. The tape dispenser of claim 1, further comprising:

a second and third of the three attachment points rotatably connected to two roller assemblies, respectively, whereby a surface can be used to self-align the outer face of the tape hub relative to an outer side of both roller assemblies.

4. The tape dispenser of claim 1, further comprising:

the body plate having a front surface and a rear surface opposing the front surface;

the front surface providing the three attachment points; and a handle pivotable connected to the rear surface.

5. The tape dispenser of claim 4, further comprising:

a handle lock configured to move the handle between a locked condition and an unlocked pivotable condition.

6. The tape dispenser of claim 1, further comprising:

one or more locking mechanism disposed along the tape hub, each locking mechanism movable between an unlocked position and a locked position fixing the outward face of the tape hub relative to said first attachment point.

7. The tape dispenser of claim 1, further comprising:

a cutting handle pivotably connected about the first of the three attachment points; and the cutting handle providing a nesting beak having a mouth.

8. The tape dispenser of claim 7, further comprising:

a plurality of linkage components and linkage pivots interconnecting said cutting handle and said nesting beak.

9. The tape dispenser of claim 7, further comprising:

a cutting blade disposed upward and inward of a center of each of the second attachment point and third attachment point of the three attachment points; and the cutting blade disposed along a nested cavity, wherein the nesting beak is dimensioned to be slidably received in the nested cavity so that the cutting blade is slidably received in said mouth.

* * * * *